United States Patent [19]

Altman

[11] Patent Number: 4,462,067

[45] Date of Patent: Jul. 24, 1984

[54] SPOTLIGHT AND ADJUSTING SYSTEM

[75] Inventor: Charles W. C. Altman, Yonkers, N.Y.

[73] Assignee: Altman Stage Lighting Co., Inc., Yonkers, N.Y.

[21] Appl. No.: 483,282

[22] Filed: Apr. 8, 1983

[51] Int. Cl.[3] ..... F21V 7/00

[52] U.S. Cl. ..... 362/268; 362/261; 362/277; 362/285; 362/307; 362/308; 362/319; 362/321; 362/280; 362/281; 362/418

[58] Field of Search ..... 362/268, 267, 285, 309, 362/308, 319, 321, 277, 280, 281, 418

[56] References Cited

U.S. PATENT DOCUMENTS

| | | | |
|---|---|---|---|
| 4,210,955 | 7/1980 | Labrom | 362/321 |
| 4,338,654 | 7/1982 | Logothetis | 362/285 |
| 4,350,417 | 9/1982 | Freeman | 362/321 |

*Primary Examiner*—Stephen J. Lechert, Jr.
*Attorney, Agent, or Firm*—Lackenbach, Siegel, Marzullo, Presta & Aronson

[57] ABSTRACT

The present invention provides a spotlight adjusting system for controlling the beam of a spotlight. A ellipsoidal reflector-lamp assembly is movable to a plurality of positions relative to the iris. The diaphragm of the iris is independently adjustable to a plurality of positions so that the light being reflected from the focal area of the reflector assembly can be controlled between passing the full beam received at the iris to a portion of the beam received there. The rear lens is adjustable relative to the iris and the front lens. The system provides mounting structures for both a long throw and a short throw front lens so that the system can be selectively mounted with either a removable long or short focal front lens.

11 Claims, 5 Drawing Figures

SPOTLIGHT AND ADJUSTING SYSTEM

This invention relates to projectors, particularly to spotlights, and more particularly, to the art of spotlight adjusting systems.

BACKGROUND OF THE INVENTION

Various methods have been used to adjust light beam throw length, beam size, and intensity for spotlights. Theaters generally are of such a size that the beam is focused between the approximate throw ranges of around 100 feet and 200 feet.

The light projector generally used in the art of theater spotlights is an ellipsoidal type that reflects the light from the lamp to a focal area spaced from the lamp from where the light spreads outwardly in a cone. An iris receives and passes the cone of light to focusing lenses.

Recent advances in the art of ellipsoidal reflector lamp assemblies has created candlepowers far beyond those delivered by prior art assemblies, except for high intensity carbon or Xenon arc lights. This new development has also created the opportunity to modify the spotlight to change candlepower ranges. In particular, the new General Electric Mark 350 reflector lamp assembly now being marketed can deliver up to about 12 million candle power on about 300 watts of power as compared to the old systems that deliver for example, about 2.4 million candle power from a 575 watt lamp or 10 million candle power from 1200 watts. The new GE lamp is a small lamp that can create a high intensity from very low wattage. This in turn creates opportunities for new spotlight adjustment systems relating to beam range and illumination that would formerly have been of marginal value.

Adjustment of the reflector lamp assembly relative to the iris is known. For example, U.S. Pat. No. 4,338,654 teaches the movement of the reflector relative to the iris and a simultaneous automatic opening and closing of the diaphragm iris by way of the same controls with the reflector so that the aperture of the iris diaphragm always captures the full beam being emmanated from the focal area of the light reflected from the reflector.

While the inventiveness of the above-described prior art patent is not to be minimized, it is nevertheless worth mentioning a serious drawback of the mechanism. That is, the iris diaphragm is not adjustable relative to the movement of the reflector. The lack of flexibility seriously flaws the usefulness of the mechanism. As one example of this lack of flexibility is the case where a certain intensity of illumination is required to stage in a wide spot and then a small spot is required. If the reflector assembly and iris diaphragm are linked, then the wide spot will have a low intensity and the small spot will have a high intensity with a possible variation exceeding a ten to one ratio. Such intensity changes are unacceptable when compared to other stage illumination, especially if TV or film cameras are being used due to the contrast of limits of the cameras.

Another disadvantage of prior art systems is that a spotlight is made either for a long throw beam, about 200 feet to stage, or a short throw beam, around 100 feet to stage. In former spotlight systems this inflexible construction was standard which requires a multiplicity of spotlight assemblies to meet all requirements.

Accordingly, it is an object of the present invention to provide a spotlight system that is flexible in its applicability over a wide range of theatrical situations that call for varied light intensity, range, and beam spread.

It is another object of this invention to provide a spotlight system which incorporates a reflector-lamp assembly of high intensity and low wattage whose beam of light is adjustable relative to an iris.

It is yet another object of this invention to provide a spotlight system that provides both an adjustable reflector-lamp assembly and an independently adjustable iris that can be adjusted simultaneously with the movement of the reflector.

It is yet another object of this invention to provide a spotlight system that provides an independently adjustable iris that can be widened or closed as the adjustable reflector-lamp assembly is moved from or towards the iris respectively in order to pass that portion of the illuminative power passed from the reflector that is required on stage.

It is still a further object of this invention to provide a spotlight system that includes a pair of spaced mountings each of which is adapted to receive a fixed front lens so that a single spotlight housing can be adapted as a short throw or a long throw spotlight system.

In accordance with these and other objects, there is provided a spotlight adjusting system for controlling the beam of a spotlight that comprises a base structure, an elliposidal reflector-lamp assembly mounted on the structure adapted to reflect light rays to a focal area; an iris mounted on the structure spaced from the reflector-lamp assembly for selectively controlling the passage of light rays from the focal area; a fixed front lens mounted on the structure; and a rear focusing lens mounted on the structure used to focus the light rays from the iris into a light beam directed by the front lens to an area remote from the spotlight. The reflector-lamp assembly is movable to a plurality of positions between a forward position and a rearward position, the forward position being nearer to the iris than the rearward position. The diaphragm of the iris is independently adjustable relative to the reflector-lamp assembly so that the light rays being radiated from the focal area can be gathered in their entirety and passed to the lenses, or the light rays can be reduced to a selected luminosity and sent to the lenses.

BRIEF DESCRIPTION OF THE DRAWINGS

The invention will be more clearly understood from the following description of a specific embodiment of the invention together with the accompanying drawings wherein similar reference characters denote similar elements throughout the several views, and in which.

DESCRIPTION OF THE PREFERRED EMBODIMENTS

Reference is now made in detail to the drawings.

Figure 1:
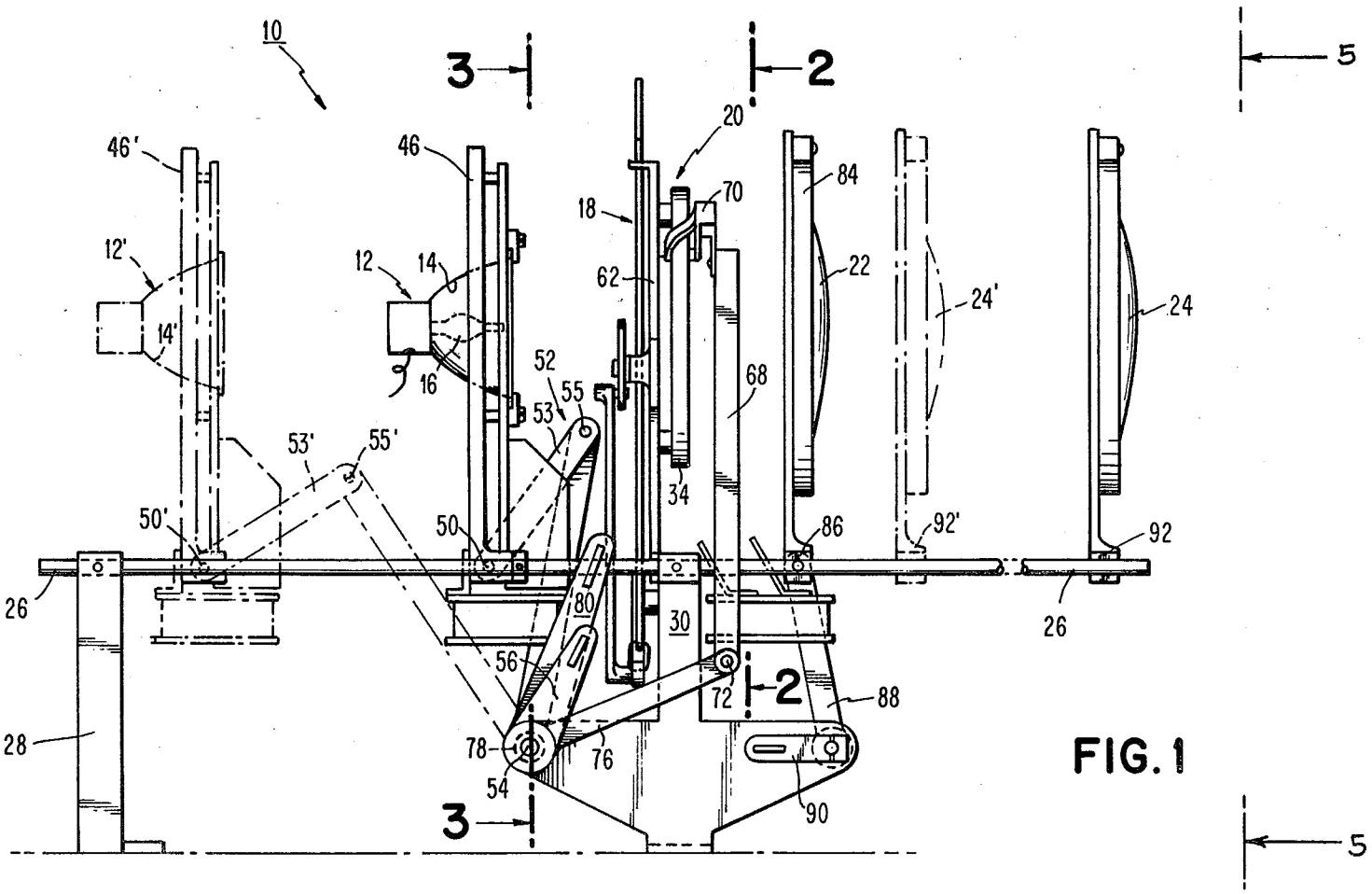
FIG. 1 shows a side elevational view of the inventions.

A spotlight adjusting system 10 is shown in a side elevational view in FIG. 1. System 10 includes a reflector lamp assembly 12 including an ellipsoidal reflector 14 and lamp 16 positioned at one focus of the ellipsoidal reflector. System 10 also includes a framing shutter 18 spaced from reflector 14, an iris system 20 in turn spaced from shutter 18, a rear lens 22 spaced from iris system 20, and a fixed front objective lens 24 spaced from rear lens 22. System 10 is mounted on a pair of parallel longitudinal supports 26 which are in turn mounted on a pair of vertical rear supports 28 and a pair of vertical front supports 30. The elongated support structure 26, 28 and 30 and spotlight adjusting system 10 are mounted within a spotlight housing (not shown) with vertical supports 28 and 30 setting upon internal housing supports (not shown) in a known manner. Reflector-lamp assembly 12 is mounted at one end of the support structure and front lens 24 is mounted at the other end of the support structure or on another suitable mounting.

Figure 4:
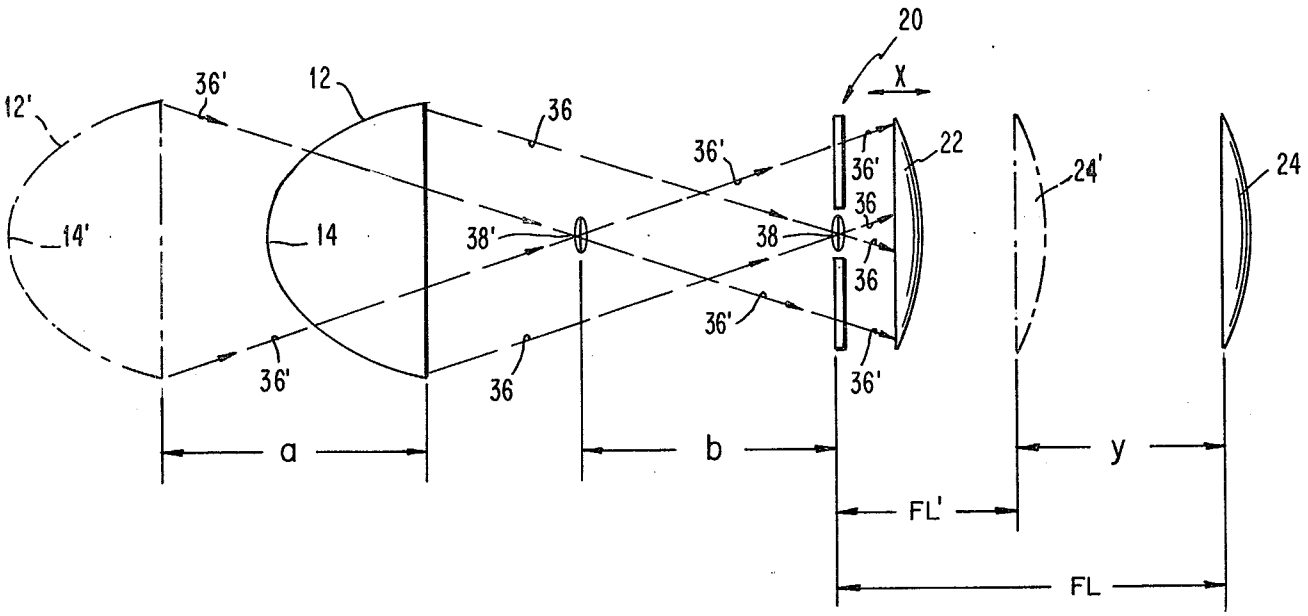
FIG. 4 is a schematic representation of the present invention showing the reflector in its two extreme positions and also showing the replaceable front objective lens.

Reference is now made to the schematic representation of spotlight adjusting system 10 shown in FIG. 4, which is directly analogous to the elevation shown in FIG. 1. Iris system 20 shown in FIG. 1 includes an adjustable diaphragm 32, clearly seen in its closed mode in FIG. 2, and a diaphragm mounting 34 which supports diaphragm 32 in a known manner. Reflector 14 reflects light rays, the peripheral rays of which are darkened and designated by numeral 36, to a focal area designated by numeral 38. Light rays 36 after passing through focal area 38 immediately pass through iris system 20, which is located at focal area 38, where they form the image, and pass on to rear lens 22, from where the rays are directed to front lens 24 from where a beam is formed that is directed onto the stage. Rear lens 22 is adjustable relative to front lens 24 over a preselected distance, schematically designated by the letter "X" in FIG. 4, so that light rays 36 can be focused.

In accordance with the present invention, reflector-lamp assembly 12 is movable to a plurality of positions between a forward position, shown as assembly 12 as described with focal area 38 positioned at iris system 20, and a rearward position, shown in phantom lines and designated by numeral 12'. The distance over which reflector-lamp assembly 12 is movable is designated by the letter "a". At the same time as reflector-lamp assembly 12 is moved from its forward position 12 to its rearward position 12', the focal area is in turn moved from its forward position 38 to its rearward position 38' from where light rays 36' divurge to iris system 20 where the light rays are passed to rear lens 22. The distance that the focal area moves between forward position 38 and rearward position 38' is designated by the letter "b". Distance b is exactly equal to distance a since reflector 14 has a focal area that remains constant in distance from itself.

An aperture is formed by and located at the center of diaphragm 32. The aperture is adjustable to a plurality of aperture modes ranging between the minimal opening shown in FIG. 2 designated as aperture 40 to a fully open mode (not shown) in which the plates 42 of diaphragm 32 are pulled back to circular diaphragm rim 44 of diaphragm mounting 34 so that aperture 40 can be enlarged to rim 44 and reduced to a minimal aperture opening 40.

Figure 2:
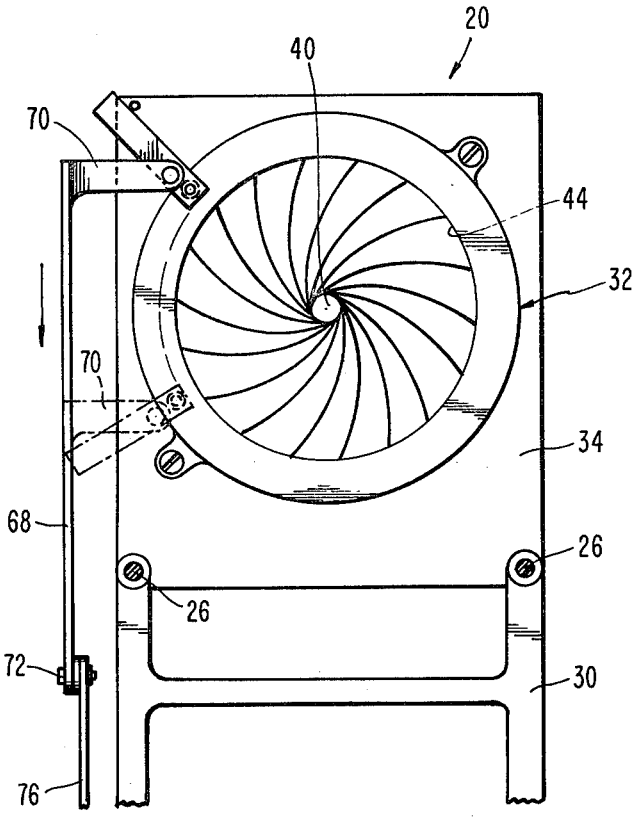
FIG. 2 shows a view taken through line 2—2 of FIG. 1 illustrating the lens in a closed position.

FIG. 4 shows focal area 38 positioned in aperture 40 when the aperture is in its minimal opening mode as shown in FIG. 2, that is, when reflector-lamp assembly 12 has been positioned in its forward position. FIG. 4 also shows focal area 38' positioned spaced away from lens system 20 when the reflector-lamp assembly has been positioned in its rearward position 12'. In the latter position, light rays 36' expand in a cone configuration from focal area 38' and pass through aperture 40 when the aperture is fully opened to rim 44. It is generally desirable that aperture 40 be controlled so as to be of the same planar area as that of the cone of the light rays that pass through focal area 38. It is noted that when reflector-lamp assembly 12 is at its most forward point, aperture 40 of diaphragm 32 is in the preferred embodiment generally aligned with focal area 38. In accordance with the present invention, aperture 40 can be independently adjusted either (1) to pass the outer light rays 36 of focal area 38, or outer light rays 36' of focal area 38', or the outer light rays of any intermediate position of the focal area; or (2) to pass only a selected portion of the light rays passing through the focal area, with the result that a lower candlepower of light is passed to the lens and the stage, so that a lower intensity of light is focused on stage. By adjusting either reflector-lamp assembly 12 relative to the area of aperture 40, or by adjusting the area of aperture 40 to the cone of light rays passing from the focal area (38, 38', or positions intermediate) or by adjusting both, the intensity of light focused on stage can be controlled over a wide range. That is, all or a selected portion of the light rays passing through the focal area can be passed to rear and front lenses 22 and 24 and to the stage.

Figure 3:
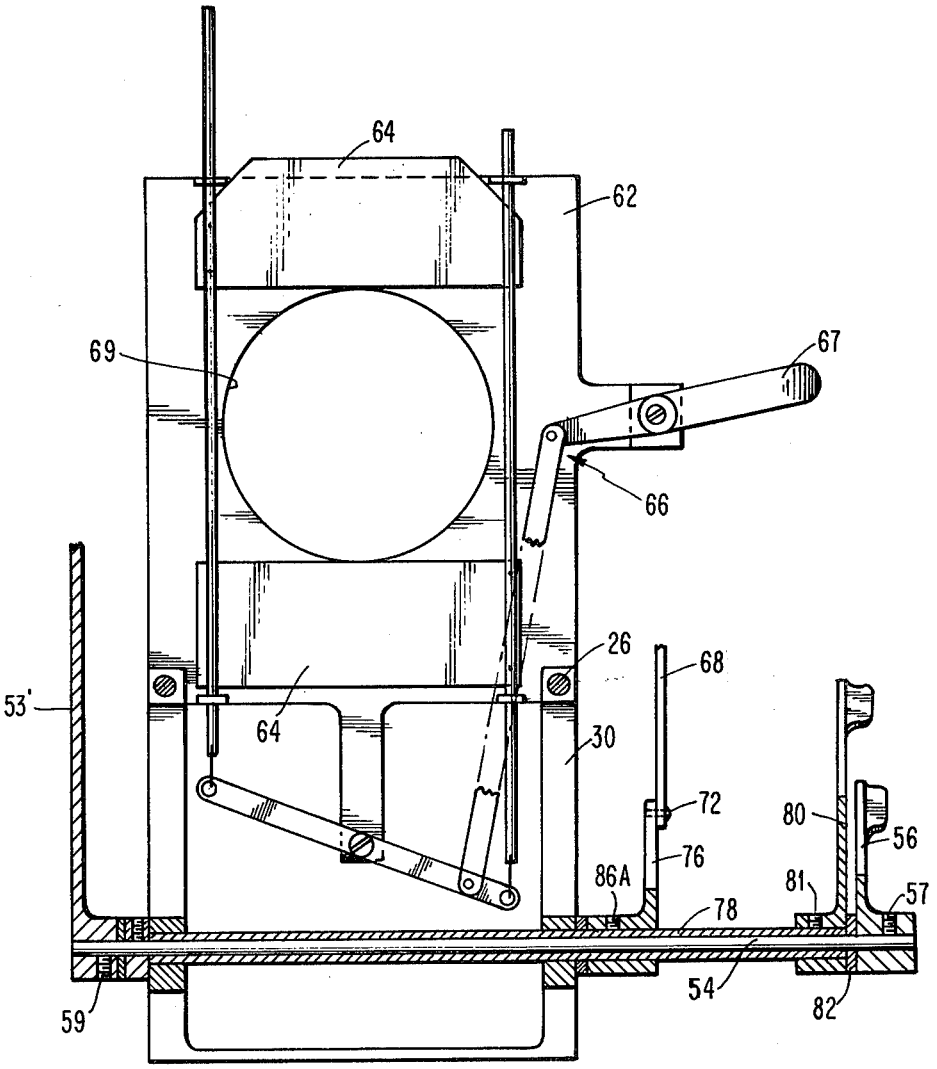
FIG. 3 shows a view taken through line 3—3 of FIG. 1.

FIG. 1 illustrates reflector-lamp assembly 12 secured to assembly mounting 46 which in turn is slidably connected to pin 50. Lamp assembly 54 is cantilevered from assembly shaft 54. Jointed leverage 52 includes levers 53 and 51 rotatably connected at pin 55. Lever 53 is connected to one of the pins 50 and lever 51 is connected to assembly shaft 54. As shown in FIG. 3, assembly shaft 54 extends laterally, or perpendicularly to longitudinal supports 26. Assembly shaft control handle 56 is fixed to assembly shaft 54 by way of set screw 57, and lever 51 is fixed to shaft 54 by way of another set screw 59. As handle 56 is pulled either towards or away from reflector-lamp assembly 12, assembly shaft 54 is rotated so as to cause jointed leverage 52 to lever reflector-lamp assembly 12 along distance "a" either away from or towards iris system 20.

As shown in FIGS. 1 and 3, iris system 20, specifically diaphragm rim 44, is secured to longitudinal supports 26 via baffle mounting 62, which is positioned between reflector-lamp assembly 12 and iris system 20. Baffles 64 and baffle controls 66 including baffle handle 67 and baffle opening 69 are illustrated in FIG. 3. Diaphragm 32 of iris system 20 is controlled by diaphragm control rod 68 which is connected to diaphragm 32 via diaphragm controls 70. Diaphragm control rod 68 in turn is rotatably connected to pin 72. A lever arm 76 is rotatably connected to pin 72 at one end and fixed to a hollow diaphragm control shaft 78 at the other end. A diaphragm control shaft handle 80 is connected to diaphragm control shaft 78 by way of locking screw 81.

In accordance with the present invention, and as seen in FIGS. 1 and 3, assembly shaft 54, which is connected to lever 51, is rotatably journaled within diaphragm control shaft 78 in a concentric mounting. Assembly shaft control handle 56 is positioned proximate to diaphragm control handle 80, with the two control handles separated by a ring 82 mounted around shaft 54.

Rear focusing lens 22 is mounted on a lens mounting 84 in turn slidably mounted on a lens track 86 so that lens 22 can be adjusted as a focusing lens via a lens lever 88 connected to a lens control handle 90.

Figure 5:
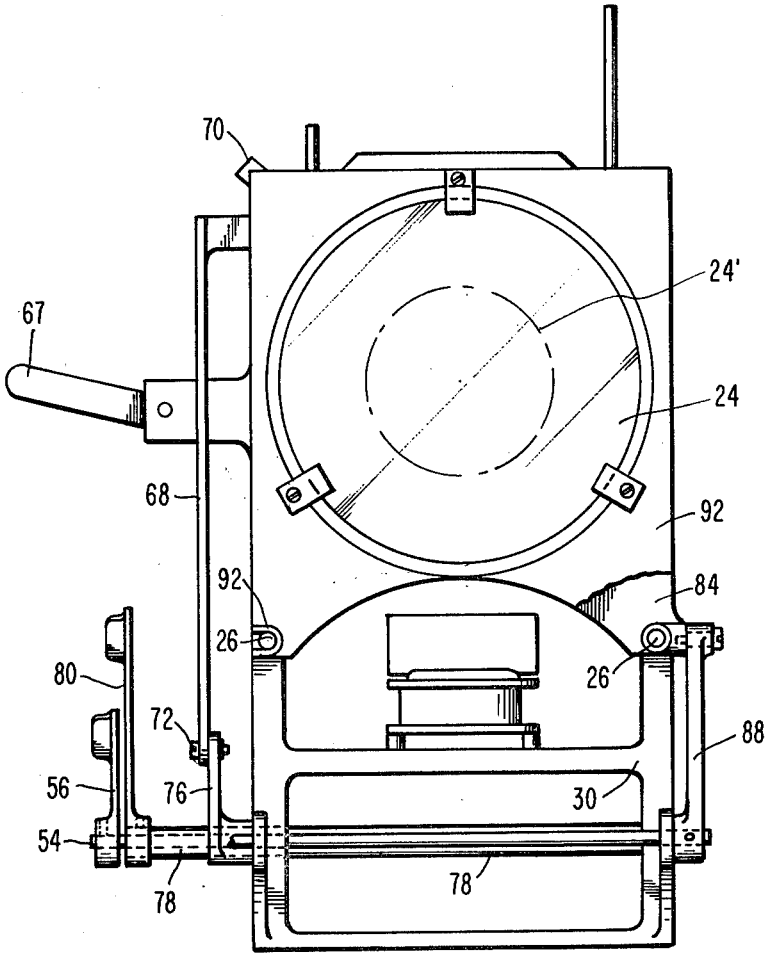
FIG. 5 shows a view taken through line 5—5 of FIG. 1.

In accordance with the present invention as shown in FIGS. 4 and 5, fixed front lens 24 is connected to front lens mounting 92 which in turn is removably connected to the base structure of system 10 at longitudinal supports 26. Front lens 24 at a first forward position shown in FIGS. 1 and 4 has a focal length (FL) of 32 inches to lens system 20, which contains the image to be focused and projected. Front lens 24 is removable and replaceable with a front lens 24' at a second forward position at mounting 92' shown in FIGS. 1 and 4 that is nearer to lens system 20 with a focal length (FL') of 16 inches. First lens 24 has a diameter of approximately 11 inches, and first lens 24' has a diameter of approximately 6 inches. First lens 24 with focal length of 32" gives a long throw capacity of about 200 feet to the system, while front lens 24' with the focal length of 16" gives a short throw capacity of about 100 feet to the system. The distance between lens 24 and lens 24' is shown as distance "y" in FIG. 4.

The embodiment of the invention particularly disclosed and described hereinabove is presented merely as an example of the invention. Other embodiments, forms, and modifications of the invention coming within the proper scope and spirit of the appended claims will, of course, readily suggest themselves to those skilled in the art.

What is claimed is:

1. An improved spotlight adjusting system for controlling the beam of a spotlight, comprising:

a base stucrture, a reflector-lamp assembly means mounted on said structure for collecting light rays and directing them to a focal area, iris means mounted on said structure spaced from said reflector-lamp assembly means for selectively controlling the passage of light rays from said focal area, lens means mounted on said structure for focusing said light rays from said iris means into a light beam directed by said lens means to an area remote from said spotlight system, said reflector-lamp assembly means being movable to a plurality of positions between a forward position and a rearward position, said forward position being nearer to said iris means than said rearward position, said focal area being aligned with said iris means in said forward position and spaced from said iris means in said rearward position, iris control means for independently adjusting the area of the aperture of said iris means for passing light rays from said focal area to said lens means, and reflector-lamp control means for independently adjusting said reflector-lamp means to a selected position of any of said plurality of positions between said forward and rearward positions, said iris control means and said reflector-lamp control means being capable of being operated in combination to pass either all the light rays or a selected portion of the light rays passing through said focal area from said reflector-lamp assembly means at any said selected position to said lens means.

2. The improved spotlight adjusting system according to claim 1, wherein said reflector-lamp assembly means includes an ellipsoidal reflector-lamp assembly and an assembly mount for holding said reflector-lamp assembly, said reflector-lamp control means including a reflector-lamp assembly control mechanism connected to said assembly mount adapted to move said reflector-lamp assembly between said forward and said rearward positions, said reflector-lamp assembly control mechanism including an assembly control shaft extending outwardly from said base structure.

3. The improved spotlight adjusting system according to claim 2, wherein said iris means includes a diaphragm forming an aperture and a diaphragm mounting adapted to hold said diaphragm, said iris control means including a diaphragm control mechanism connected to said diaphragm for opening said aperture to a fully open position wherein said aperture is capable of passing the light rays from said focal area when said reflector-lamp assembly is in said rearward position and for closing said aperture to a minimal opening wherein said aperture is capable of passing the light rays from said back area when said reflector-lamp assembly is in said forward position, said diaphragm control mechanism including a diaphragm control shaft extending outwardly from said base structure.

4. The improved spotlight adjusting system according to claim 3, wherein said assembly control shaft and said diaphragm control shaft are concentrically mounted.

5. The improved spotlight adjusting system according to claim 4, wherein said lens means includes a fixed front objective lens mounted on said base structure and a rear focusing lens mounted on said base structure between said diaphragm and said front lens, said rear lens being adjustably movable relative to said front lens.

6. The improved spotlight adjusting system according to claim 5, wherein said front lens is a long throw front lens having a long focal length from said diaphragm.

7. The improved spotlight adjusting system according to claim 5, wherein said front lens is a short throw front lens having a short focal length from said diaphragm.

8. The improved spotlight adjusting system according to claim 5, wherein said front lens is selectively either a long throw front lens or a short throw front lens, said long throw front lens having a long focal length from said diaphragm and said short throw front lens having a short focal length from said diaphragm.

9. The improved spotlight adjusting system according to claim 8, wherein said long focal length is 32 inches and said short focal length is 16 inches.

10. An improved spotlight adjusting system according to claim 4, further including an assembly control handle connected to said assembly control shaft and a diaphragm control handle connected to said diaphragm control shaft, said assembly control handle and said diaphragm control handle are positioned in proximity.

11. An improved spotlight adjusting system for controlling the beam of a spotlight, comprising:

a base structure, a reflector-lamp assembly means mounted on said structure for collecting light rays and directing them to a focal area, iris means mounted on said structure spaced from said reflector-lamp assembly means for selectively controlling the passage of light rays from said focal area, lens means mounted on said structure for focusing said light rays from said iris means into a light beam directed by said lens means to an area remote from said spotlight system, said reflector-lamp assembly means being movable to a plurality of positions between a forward position and a rearward position, said forward position being nearer to said iris means than said rearward position, said focal area being aligned with said iris means in said forward position and spaced from said iris means in said rearward position, iris control means for independently adjusting the area of the aperture of said iris means for passing light rays from said focal area to said lens means, reflector-lamp control means for independently adjusting said reflector-lamp means to a selected position of any said plurality of positions between said forward and rearward positions, said iris control means and said reflector-lamp control means being capable of being operated in combination to pass either all the light rays or a selected portion of the light rays passing through said focal area from said reflector lamp assembly means at any said selected position to said lens means, said iris control means including a diaphragm control shaft extending outwardly from said base structure and said reflector lamp assembly means including an assembly control shaft extending outwardly from said base structure, said diaphragm control shaft and said assembly control shaft being concentrically mounted, a diaphragm control handle connected to said diaphragm control shaft, and an assembly control handle connected to said assembly control shaft, said assembly control handle and said diaphragm control handle being positioned in proximity.

* * * * *